US007239712B1

(12) United States Patent
Drury et al.

(10) Patent No.: US 7,239,712 B1
(45) Date of Patent: Jul. 3, 2007

(54) INDUCTOR-BASED MEMS MICROPHONE

(75) Inventors: Robert Drury, Santa Clara, CA (US); Peter J. Hopper, San Jose, CA (US); Michael Mian, Livermore, CA (US); Peter Johnson, Sunnyvale, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 492 days.

(21) Appl. No.: 10/874,451

(22) Filed: Jun. 23, 2004

(51) Int. Cl.
*H04R 9/00* (2006.01)

(52) U.S. Cl. ..... 381/175; 381/176; 381/177

(58) Field of Classification Search ..... 381/171, 381/175, 176, 177, 396, 399, 406; 29/594, 29/596; 310/324
See application file for complete search history.

(56) References Cited

U.S. PATENT DOCUMENTS 7,054,460 B2 * 5/2006 Rombach et al. ..... 381/421

OTHER PUBLICATIONS

Tounsi, et al., CMOS integrated micromachined inductive microphone, Microelectronics, 2004. ICM 2004 Proceedings. The 16th International Conference on Dec. 6-8, 2004 pp. 109-112.*

"Nonlinear Effects in MEMS Capacitive Microphone Design", S. Chowdhury, M. Ahmadi, W.C. Miller, Electrical and Computer Engineering University of Windsor, Proceedings of the International Conference on MEMS, NANO and Smart System (ICMENS'03), 2003, IEEE.

* cited by examiner

*Primary Examiner*—Sinh Tran
*Assistant Examiner*—Walter F Briney, III
(74) *Attorney, Agent, or Firm*—Stallman & Pollock LLP

(57) ABSTRACT

An inductor-based integrated MEMS microphone and a method of making the microphone is provided. The microphone structure includes a vibrating inductor that is suspended over another stationary inductor such that the magnetic field induced from one inductor induces an electrical potential across the other. The stationary inductor is embedded in a dielectric material that is etched out over the stationary inductor to provide the cavity over which the vibrating inductor is suspended.

14 Claims, 3 Drawing Sheets

INDUCTOR-BASED MEMS MICROPHONE

FIELD OF THE INVENTION

The present invention utilizes integrated inductor technology to provide a high sensitivity, linear MEMS microphone.

DESCRIPTION OF THE INVENTION

Micro-Electro-Mechanical Systems (MEMS) involve the integration of mechanical elements, sensors, actuators, and electronics on a common silicon substrate through microfabrication technology. While the electronics of a MEMS device are fabricated using integrated circuit (IC) process sequences, the micromechanical components are fabricated using compatible "micromachining" processes that selectively etch away parts of a silicon wafer or add new structural layers to the wafer to form the mechanical and electromechanical devices.

As discussed by J. Ouellete, The Industrial Physicist, August 1999, the earliest silicon-microphone designs utilized two silicon chips to emulate the advantages of conventional electret microphones. One chip serves as the microphone membrane and the other chip serves as the electrode or backplate. Together, the two chips form a capacitor. As the membrane vibrates in response to sound, the capacitance changes, creating an electrical signal in a circuit connected to the device. Capacitive solutions have the disadvantage of sensitivity, as the capacitance changes as function of $1/d^2$ where d is the distance between the oscillating membrane and the underlying plate.

Two-chip capacitive silicon microphones provide good acoustical properties, but new manufacturing techniques now enable the fabrication of the entire device on a single chip. Single-chip designs are preferred because they do not require bonding two chips together, but the production process is more complex and expensive.

Piezoresistive and piezoelectric silicon microphones are also utilized. The piezoresistive microphones are single-chip devices that use materials as membranes whose electrical resistivity changes with changes in mechanical stress caused by the deflection of the sound waves. Piezoelectric microphones have a similar design and operation, but the materials of these devices generate differences in electrical potential at the surface instead of changing resistivity. However, piezo systems suffer from both insensitivity and the requirement to utilize expensive pieze materials such as ZnO and AlN.

A MEMS microphone in accordance with the invention utilizes a magnetic mechanism to achieve the same result as capacitive or piezo devices, but with several advantages. The present invention is based upon a more standard integrated inductor technology with the addition of an etched out underlying layer in the silicon to form the microphone cavity. The idea is to suspend an inductor over another fixed inductor such that the magnetic field induced from one induces an electric potential across another.

Figure 1:
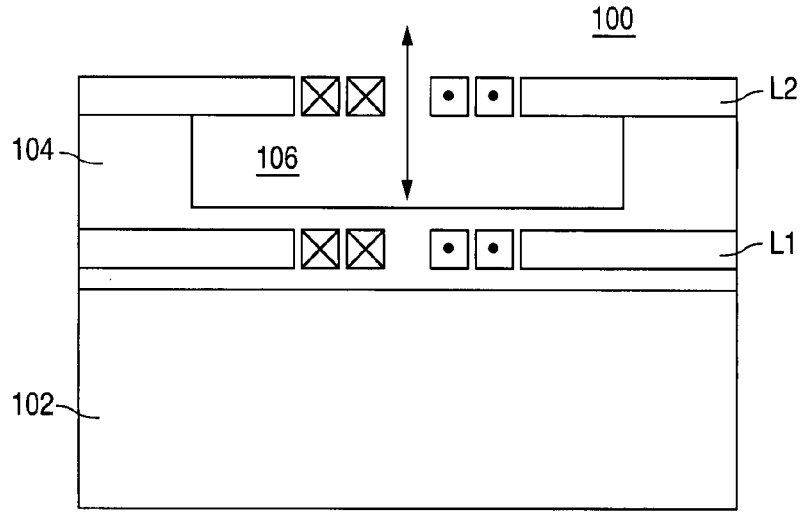
FIG. 1 is a partial cross section drawing illustrating an inductor-based MEMS microphone structure in accordance with the concepts of the present invention.

FIG. 1 shows an integrated microphone structure 100 formed on a semiconductor structure 102, preferably crystalline silicon. The microphone structure 100 includes a stationary inductor structure L1 that is embedded in a layer of dielectric material 104 formed on the upper surface of the semiconductor substrate 102. The stationary inductor structure L1 is preferably formed from aluminum, copper, an aluminum-copper alloy, or a silicide version of any of these materials. The dielectric material 104 may be silicon oxide or a suitable polymer material of the type typically utilized in integrate circuit fabrication for these applications. A cavity 106 is formed in the dielectric material 104 over the stationary embedded inductor structure L1. A vibrating inductor structure L2 is suspended over the cavity 106 and over and separated from the stationary embedded inductor structure L1. The distance separating the stationary embedded inductor structure L1 and the vibrating inductor structure s about 0.01 μm to about 3.0 μm. The integrated microphone structure 100 may also include a layer of dielectric material (not shown in FIG. 1) formed over the vibrating inductor structure L2 to ensure a better coupling to the incoming transverse acoustic wave.

Optionally, depending upon sensitivity requirements, either or both inductors may be driven with either a DC or AC signal. The induced signal on the recipient inductor, relates to the displacement current induced by the moving B-field. In the case of the DC signal, the signal is induced as a function of distance (Maxwell's $2^{nd}$ equation). In the case of the AC signal, an extra term (and hence extra sensitivity) associated with induced E-field leads to more output signal. (Maxwell's $3^{rd}$ equation).

FIGS. 2A through 2H show an embodiment of a method that can be used in fabricating an integrated microphone structure in accordance with the concepts of the present invention. Those skilled in the art will appreciate that, although the overall fabrication method shown in the FIGS. 2A-2H sequence is unique, the individual steps of the method can be implemented in accordance with a variety of well-known integrated circuit fabrication techniques.

Figure 2A:
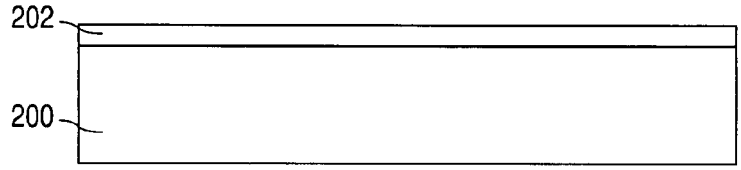
FIGS. 2A-2H are a sequence of partial cross-section drawings illustrating a method of making an inductor-based MEMS microphone structure in accordance with the concepts of the present invention.
Figure 2B:
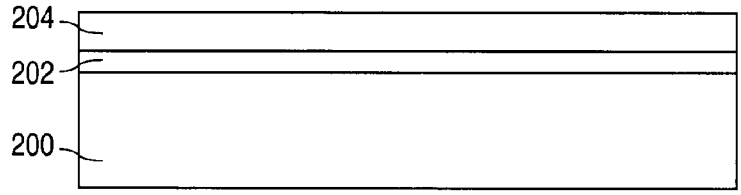
Figure 2C:
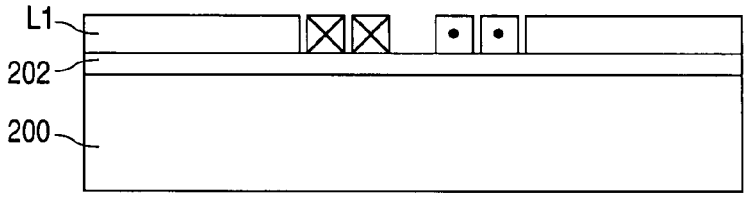

FIG. 2A shows the formation of a dielectric layer 202, for example silicon oxide or a suitable polymer material, on a crystalline silicon substrate 200. A layer of conductive material 204 is then formed on the dielectric layer 202 (FIG. 2B) and patterned to form a stationary inductor structure L1, as shown in FIG. 2C. As stated above, the L1 stationary inductor material is preferably aluminum, copper, an aluminum-copper alloy, or a conventional silicided variation of aluminum, copper, or aluminum-copper alloy.

Figure 2D:
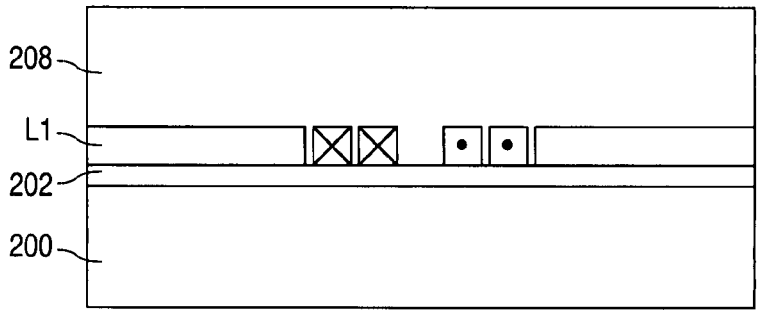
Figure 2E:
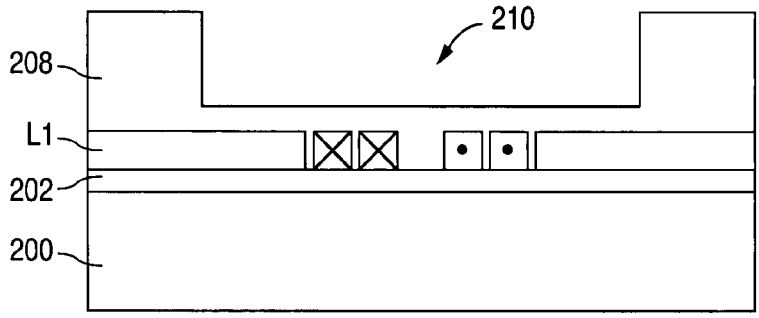
Figure 2F:
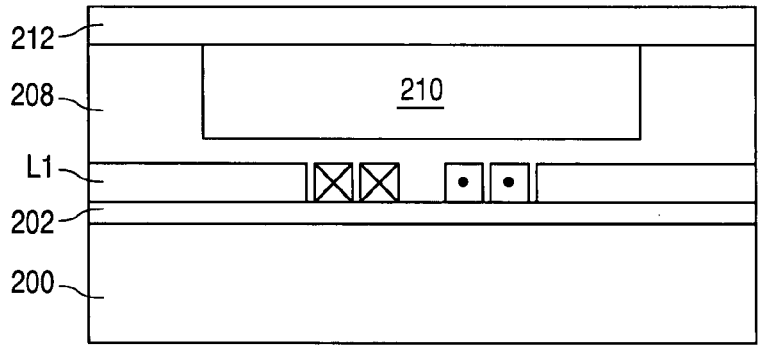

FIG. 2D shows the formation of additional dielectric material 208 to depth suitable for the formation of an inductor cavity, as discussed below. As shown in FIG. 2E, the dielectric material 208 is then etched to from a cavity 210 in the dielectric material 208 over the stationary inductor structure L1. As shown in FIG. 2E, the cavity is etched to a depth such that the L1 inductor structure remains embedded in the dielectric material.

Figure 2G:
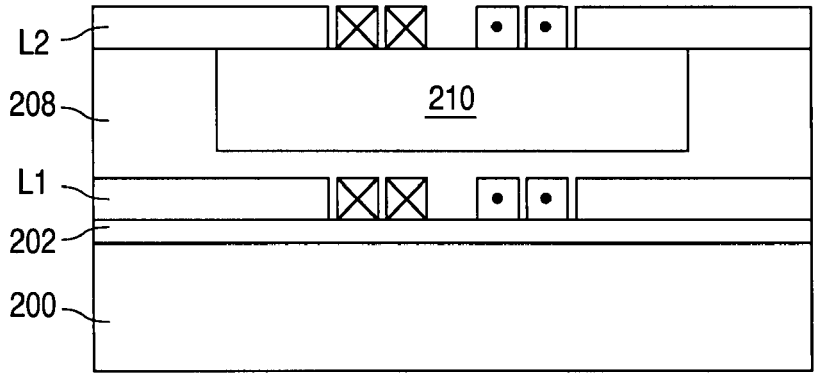

Following the formation of the cavity 210 in the dielectric material, a layer of conductive material 212 is formed over the dielectric material 208 and over the cavity 210. The conductive layer 212 is then patterned to form a vibrating inductor structure L2 that is suspended over the cavity 210 and over and separated from the stationary embedded inductor structure L1, as shown in FIG. 2G. As with the L1 inductor structure, the vibrating inductor structure L2 is preferably formed of aluminum, copper, aluminum-copper alloy, or a conventional silicided variation of aluminum, copper, or aluminum-copper alloy.

Figure 2H:
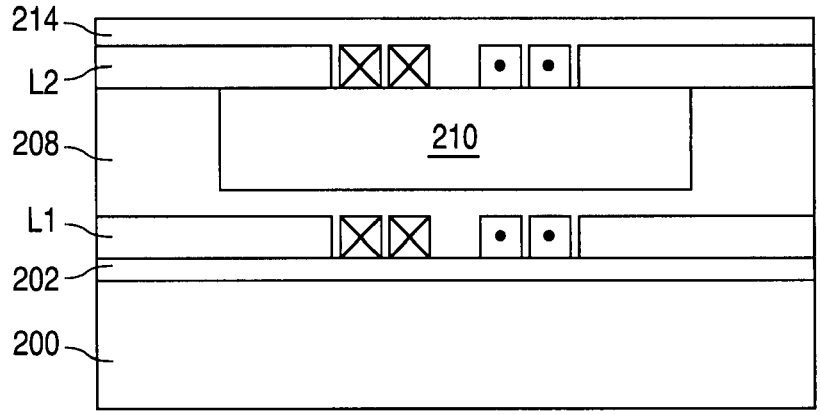

As shown in FIG. 2H, a layer of dielectric material 214 may be formed over the L2 inductor structure.

It should be understood that various alternatives to the embodiments of the invention described herein may be employed in practicing the invention. It is intended that the following claims define the scope of the invention and that structures and methods within the scope of these claims and their equivalents be covered thereby.

What is claimed is:

1. An integrated microphone structure comprising;

a stationary inductor structure embedded in a dielectric material that extends over the stationary inductor structure;

a cavity formed in the dielectric material over the stationary embedded inductor structure; and a vibrating inductor structure suspended over the cavity and separated from the stationary embedded inductor structure.

2. An integrated microphone structure as in claim 1, and further comprising:

a dielectric layer formed over the vibrating inductor structure.

3. An integrated microphone structure as in claim 1, and wherein the stationary embedded inductor structure is separated from the vibrating embedded inductor structure by a distance of about 0.01 μm to about 3.0 μm.

4. An integrated microphone structure as in claim 1, and wherein the stationary embedded inductor structure comprises a material selected from the group consisting of aluminum, copper, aluminum-copper alloys, and silicided variations thereof.

5. An integrated microphone structure as in claim 1, and wherein the vibrating inductor structure comprises a material selected from the group consisting of aluminum, copper, aluminum-copper alloys, and silicided variations thereof.

6. An integrated microphone structure as in claim 1, and wherein the dielectric material comprises silicon oxide.

7. An integrated microphone structure as in claim 1, and wherein the dielectric material comprises a polymer material.

8. A method of making an integrated microphone structure, the method comprising:

forming a layer of dielectric material on an underlying substrate;

forming a layer of conductive material on the layer of dielectric material;

patterning the layer of conductive material to form a stationary embedded inductor structure;

forming dielectric material over the stationary embedded inductor structure;

etching the dielectric material to from a cavity in the dielectric material over the stationary embedded inductor structure; and forming a vibrating inductor structure that is suspended over the cavity and over and separated from the stationary embedded inductor structure.

9. A method as in claim 8, and further comprising:

forming dielectric material over the vibrating inductor structure.

10. A method as in claim 8, and wherein the stationary embedded inductor structure is separated from the vibrating inductor structure by a distance of about 0.01 μm to about 3.0 μm.

11. A method as in claim 8, and wherein the stationary embedded inductor structure comprises a material selected from the group consisting of aluminum, copper, aluminum-copper alloys, and silicided variations thereof.

12. A method as in claim 8, and wherein the vibrating inductor structure comprises a material selected from the group consisting of aluminum, copper, aluminum-copper alloys, and silicided variations thereof.

13. A method as in claim 8, and wherein the dielectric material comprises silicon oxide.

14. A method as in claim 8, and wherein the dielectric material comprises a polymer material.

* * * * *